United States Patent [19]

Carpenter

[11] Patent Number: 4,932,167

[45] Date of Patent: Jun. 12, 1990

[54] SURFACE CLEANER

[75] Inventor: James H. Carpenter, Hagerstown, Md.

[73] Assignee: Pangborn Corporation, Hagerstown, Md.

[21] Appl. No.: 260,274

[22] Filed: Oct. 20, 1988

Related U.S. Application Data

[63] Continuation-in-part of Ser. No. 48,940, May 12, 1987.

[51] Int. Cl.[5] ..... B24B 3/06

[52] U.S. Cl. ..... 51/433; 51/432; 51/434; 51/424; 51/429; 51/436

[58] Field of Search ..... 51/410, 424, 425, 426, 51/427, 429, 431, 432, 433, 434, 436, 437

[56] References Cited

U.S. PATENT DOCUMENTS

| | | | |
|---|---|---|---|
| 4,020,596 | 5/1977 | Bergh | 51/429 |
| 4,052,820 | 10/1977 | Bergh | 51/429 |
| 4,364,823 | 12/1982 | Goff | 51/429 |
| 4,416,092 | 11/1983 | Nelson | 51/429 |
| 4,433,511 | 2/1984 | Swain | 51/429 |

*Primary Examiner*—D. S. Meislin
*Assistant Examiner*—Blynn Shideler
*Attorney, Agent, or Firm*—Charles E. Brown; Charles A. Brown

[57] ABSTRACT

A surface cleaner wherein abrasive particles are directed against a surface to be cleaned, after which the abrasive particles rebound into the cleaner and return for recirculation. Several features are involved. First there is provided an accelerator for the normally gravity flowing abrasive particles to accelerate the particles towards a throwing wheel wherein the abrasive particles are spread over a greater depth of an associated throwing vane. Some of the abrasive particles will not rebound entirely up into the machine for return to the abrasive particle supply chamber. Accordingly, there is provided a separate path for the weaker rebounding abrasive particles to return to the accelerator. The throwing wheel includes a tubular hub into which one of the supporting bearings for the associated shaft is telescoped. This permits throwing wheels of different widths to be utilized. The vanes of the throwing wheel are flat vanes having at their inner ends enlargements. The vanes slide through slots with enlarged inner openings in an axial direction for mounting and removal. The vanes can be removed from the cleaner through an opening in one of the side walls thereof after a cover plate has been removed. There is also a wear plate which controls in part the direction of flow of abrasive particles from the throwing wheel. The wear plate protects part of the housing and most particularly one of the housing seals with the surface being cleaned.

19 Claims, 4 Drawing Sheets

SURFACE CLEANER

This application is a continuation-in-part of my copending application Ser. No. 07/048,940 filed May 12, 1987.

This invention relates in general to new and useful improvements in cleaners wherein abrasive particles are directed towards a workpiece to be cleaned. The invention particularly relates to a cleaner for cleaning surfaces including, but not limited to steel decks on aircraft carriers, concrete floors, etc. The surfaces may also be overhead surfaces and vertical surfaces.

In the past, a number of patents have been granted with respect to cleaners of this general type. These patents include U.S. Pat. Nos. 4,052,820; 4,202,142; 4,336,671; 4,364,823; 4,377,922; 4,377,923; 4,377,924 and 4,416,092.

Surface cleaners of the type to which this invention relates may be divided into two classes. One class employs more expensive, complex center feed throwing wheels. The most successful commercial surface cleaner of this type is exemplified by U.S. Pat. No. 4,377,924.

The other type of surface cleaner utilizes what is generally called a batter wheel. The most successful commercial unit of this type is that disclosed in U.S. Pat. No. 4,416,092.

This invention relates in general to surface cleaners of the batter wheel type but wherein a more efficient handling of the abrasive particles is provided for.

A particular feature of this invention resides in that the cleaner has a discharge opening facing the surface to be cleaned that is wider than an outlet opening from the batter wheel and this permits a return duct portion for abrasive particles and removed material which is advantageously wider than the outlet opening.

With the above and other objects in view that will hereinafter appear, the nature of the invention will be more clearly understood by reference to the following detailed description, the appended claims, and the several views illustrated in the accompanying drawings.

Figure 1:
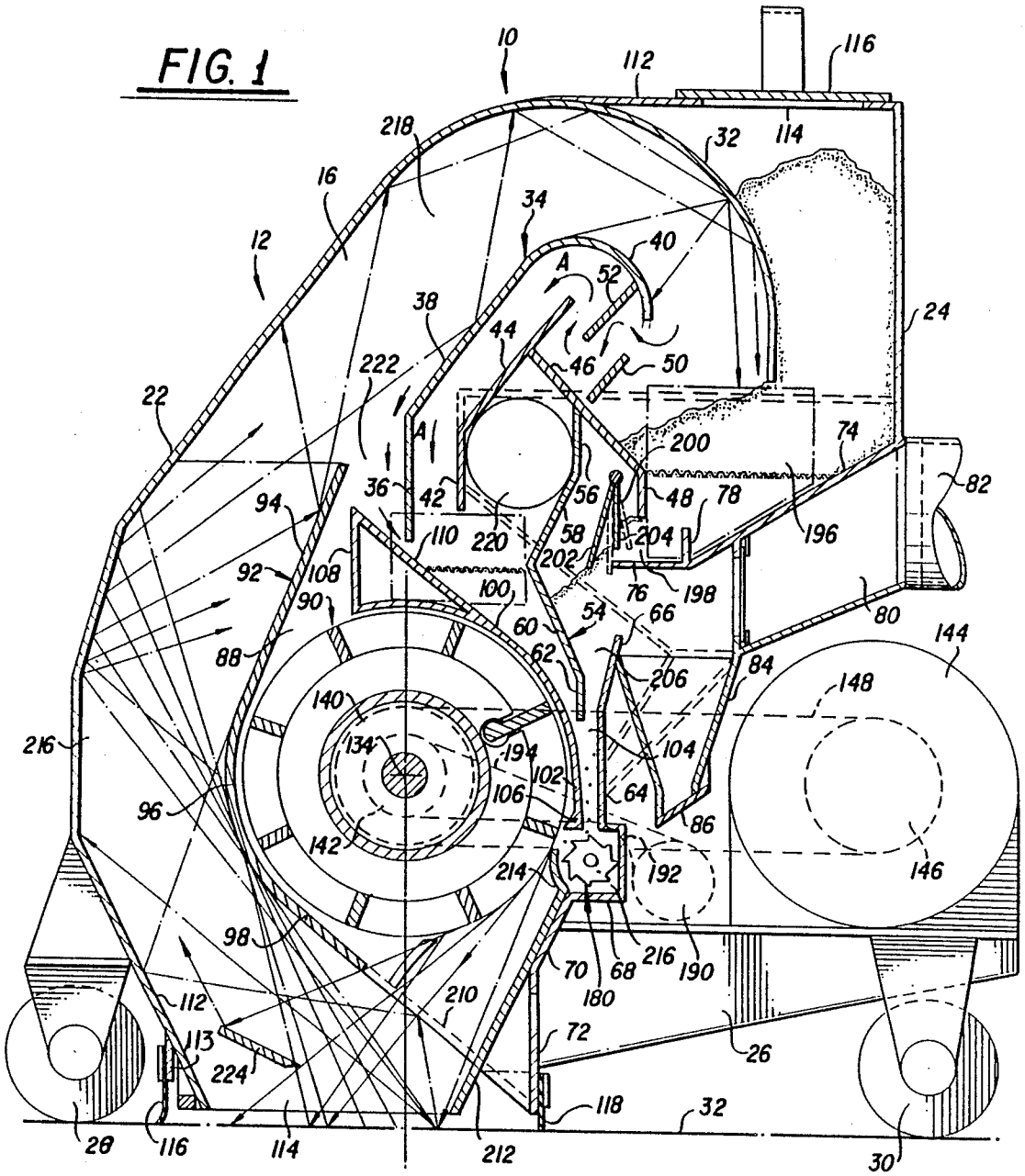
FIG. 1 is a longitudinal vertical sectional view taken through the surface cleaner showing the general details thereof including most specifically the flow of abrasive particles during operation.
Figure 2:
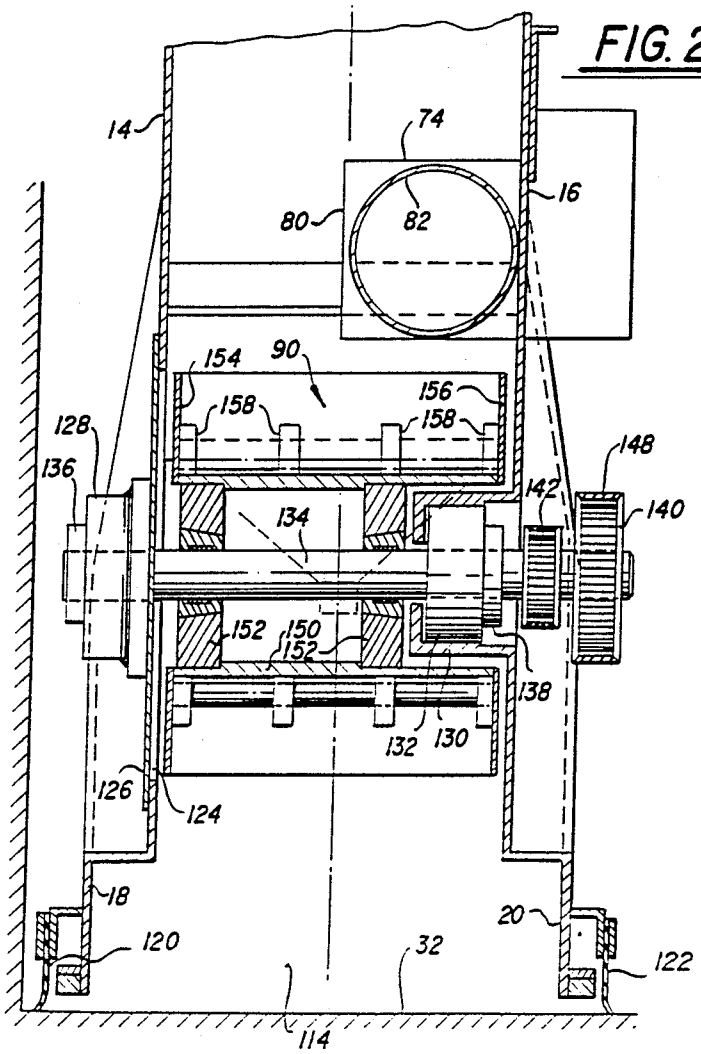
FIG. 2 is a fragmentary transverse sectional view taken generally through the center of the throwing wheel and shows further the details of the surface cleaner including the relative widths of abrasive particle outlet opening, the discharge opening and the return duct.

Referring now to the drawings in details, reference is first made to FIGS. 1 and 2 wherein there is illustrated a preferred embodiment of the surface cleaner, the surface cleaner being generally identified by the numeral 10. The surface cleaner 10 includes basically a housing, generally identified by the numeral 12. The housing 12 includes basically two side plates 14, 16 with the side plates 14, 16 having outwardly offset lower and front portions 18, 20 which taper together upwardly as is clearly shown in FIG. 2. The side plates are joined together by a combined front and top wall member 22 and by a rear wall member 24. The rear wall member 24 has extending rearwardly from the lower portion thereof a suitable support 26.

The housing 12 is supported by a pair of front wheels 28, and a pair of rear wheels 30. The rear wheels are preferably driven in any suitable manner so as to propel the cleaner along the surface to be cleaned, the surface being identified by the numeral 32.

The interior of the housing 12 is divided into a plurality of separate areas by a plurality of baffles which will be generally described. First of all, it will be seen that the wall 22 has an upper downwardly curved portion 32 which extends into the interior of the housing 12 and functions as a baffle for directing returning abrasive particles back into a supply chamber for abrasive particles, which supply chamber will be described in detail hereinafter.

Next, there is a baffle 34 having a lower vertical portion 36, an upwardly sloping portion 38 and a reversely turned upper portion 40, the portion 40 being generally concentric with the baffle 32. The next baffle includes a lower vertical portion 42 which is parallel to the baffle portion 36 and an upper upwardly sloping portion 44 which is parallel to the baffle portion 38. The baffle portion 44 has extending downwardly to the right therefrom a baffle 46 which terminates in a vertical lower portion 48. Associated with the baffle 46 is a narrower baffle 50 which is parallel to the baffle 44. A baffle 52 depends from the baffle portion 40 between the baffle portion 44 and the baffle 50.

The baffle 46 has depending from a central portion thereof a baffle, generally identified by the numeral 54, which includes a vertical upper portion 56, a sloping intermediate portion 58, a further sloping intermediate portion 60 and a lower vertical portion 62. Adjacent the lower baffle portion 62 is an upstanding baffle 64 which has a slightly sloping upper portion 66, an intermediate chamber defining portion 68, a lower downwardly sloping portion 70 and a lower vertical portion 72.

In the upper right portion of the housing 12, there is a downwardly and to the left sloping baffle 74 which has a lower horizontal portion 76 which is in underlying spaced relation with respect to the baffle portion 48. At the right end of the baffle portion 76 is an upstanding baffle portion 78.

The baffle 74 forms the upper part of a box 80 to which there is connected a vacuum duct 82. To the left of the box 80 is a downwardly opening collector 84 having a removable lower trickle valve 86 for draining.

Generally below and to the left of the aforedescribed baffles is a chamber 88 for a throwing wheel, generally identified by the numeral 90. The chamber 88, at the left, is defined by a baffle 92 having an upper portion 94 which slopes upwardly into the right. It is joined to an arcuate intermediate portion 96, which in turn, is joined to a lower portion 98 which slopes downwardly and to the right. An upper and right portion of the chamber 88 is defined by a baffle 100 which is arcuate in outline and has an upper left end which is spaced from the baffle portion 94. The baffle 100 has a vertical lower portion 102 which is disposed parallel to the baffle portion 64 to define an abrasive particle supply passage 104. The baffle portion 102 terminates in an enlargement 106.

The baffle 100 carries at its upper left end a vertical baffle portion 108 and a sloping baffle portion 110 with the baffle portion 110 underlying and being spaced from the baffle portion 36.

The housing also includes a top wall portion 112' which is joined to the front wall 22 and which may be a continuation of the rear wall 24. An opening 114' is formed in the top wall portion for supplying abrasive particles to the surface cleaner 10. The opening 114 is normally closed by a suitable cover 116'.

Referring once again to FIG. 1, it will be seen that the front wall 22 has a lower downwardly and rearwardly sloping portion 112 which defines the front side of a discharge opening 114. The wall portion 113 carries a seal forming member 116 which engages the surface 32 which is being cleaned. At this time it is also to be noted that the portion 72, which although it has been described as being a baffle portion, is an exterior wall. The portion 72 carries a sealing strip 118 forming a rear seal for the discharge opening.

Referring now to FIG. 2, it will be seen that the side wall portion 18 carries a sealing strip 120 for forming one side of the discharge opening 114, while the side wall portion 20 carries the sealing strip 122 forming the opposite side of the discharge opening 114.

Next, it will be seen that the side wall 14 has an enlarged access opening 124. The access opening 124 is normally closed by a removable plate 126 which is suitably removably secured in place by means of fasteners not shown. The plate 126 carries a shaft bearing 128.

Generally opposing the shaft bearing 128, the side wall 16 is provided with an inwardly projecting bearing support portion 130 in which there is mounted in recessed relation a shaft bearing 132. A support shaft 134 is rotatably journalled in the bearings 128, 132 and is prevented from axial shifting by means of collars 136, 138 which engage the bearings 128, 132, respectively. The right end portion of the shaft 134 carries a drive pulley or sprocket 140 and between the pulley or sprocket 140 and the collar 138 is a further pulley or sprocket 142.

Referring now to FIG. 1, it will be seen that there is mounted on the support 126 a suitable power unit 144 which carries a drive pulley or sprocket 146 which is aligned with the pulley or sprocket 140 and which is connected thereto by means of a belt 148 to rotate the shaft 134.

It will be seen that the throwing wheel 90 is of an unusual construction and includes a tubular hub 150 which carries telescoping support units 152 which mount the hub on the shaft 134.

The hub 150 is provided with a pair of annular end plates 154, 156 of which the end plate 154 is readily removable. The hub 150 also carries a plurality of axially spaced collars or rings 158 which are utilized to mount throwing blades in the throwing wheel. At this time it is to be noted that the plate 154 is in alignment with the opening 124.

Figure 3:
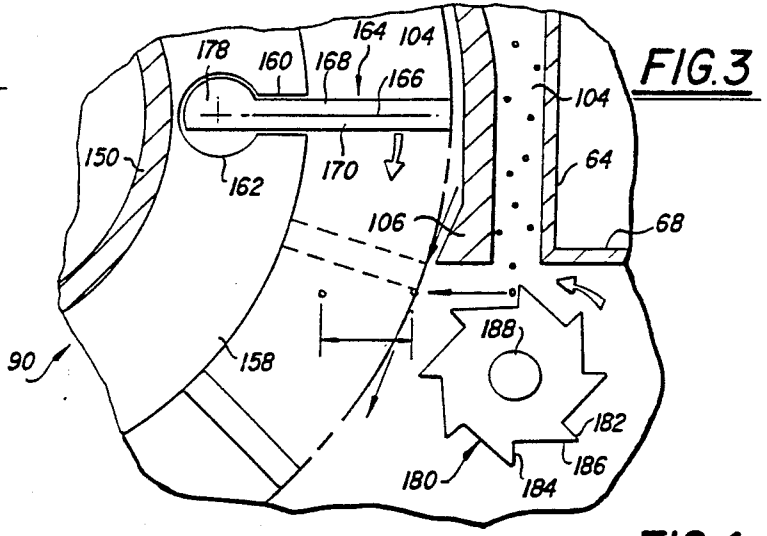
FIG. 3 is an enlarged fragmentary diagrammatic view showing the manner in which gravity fed abrasive particles are directed to the throwing wheel utilizing an accelerator wheel.

Referring now to FIG. 3, it will be seen that each collar 158 is provided with a plurality of circumferentially spaced, axial slots 160 which terminate at their radially inner end in an enlarged opening 162 which, in the illustrated embodiment, is circular in outline. The slots 160 and openings 162 in the various collars 158 are axially aligned.

The throwing wheel 90 carries a plurality of throwing vanes identified by the numeral 164. Each throwing vane 164 includes an elongated flat vane portion 166 having opposite faces 168, 170. Each vane 164 also includes a radially inner enlargement 178 which projects only from the face 168.

As will be readily apparent from FIG. 3, each vane 164 is so mounted within its respective slot 160 and opening 162 so that it cannot move radially outwardly beyond the position illustrated in FIG. 3. On the other hand, by removing the cover plate 126 and the end ring 154, one can slide the vane axially out of the throwing wheel 90 for replacement. Furthermore, by turning a vane 164 end for end, it can be reinserted so that after the face 170 thereof has become worn, the face 168 may become active.

It will be seen that by recessing the bearing 132 within the right end of the throwing wheel 90, the shaft drive elements will project a minimum. In other words, the pulleys or sprockets 140, 142 may be immediately adjacent the side plate 16 as is clearly shown in FIG. 2.

At this time it is pointed out that the housing and baffle configuration is one wherein the width of a cleaner may be varied without requiring any design changes. In other commercial units, particularly those with center feed blast wheels, this is not generally possible.

The accelerator wheel 180 has a shaft 188 which is driven from the shaft 134 in the manner best shown in FIG. 1.

The cleaner includes an idler pulley or sprocket 190 which is aligned with the pulley or sprocket 142. Further, the shaft 188, which is mounted in suitable bearings (not shown) carries a pulley or sprocket 192 over which a drive belt 194 carried by the pulleys or sprockets 142, 190 rides.

As is best shown in FIG. 3, the accelerator wheel 180 is rotated in a counterclockwise direction while the throwing wheel 90 rotates in a clockwise direction. Further, because there are the same number of teeth 182 on the accelerator wheel 180 as the number of vanes 164, there will be a separate supply of abrasive particles for each of the vanes 164. The rotation of the accelerator wheel 180 will be in timed relation to that of the throwing wheel 90 so as to provide for the timed throwing of abrasive particles towards the throwing wheel 90 for engagement by the vanes 164.

Reference is once again made to FIG. 1 wherein it will be seen that the upper right corner of the housing 12 defines a supply chamber 196 for the abrasive particles. The supply chamber 196 has an exit opening 198 between the baffle portions 48 and 76 which is controlled by the position of a two legged gate member 200. The gate member 200 has a closed position when a leg 202 thereof engages the end of the baffle portion 76. In the open position of the gate member 200, a shorter leg 204 thereof allows a limited gravity dispensing of the abrasive particles from the supply chamber 196.

The abrasive particles discharged from the supply chamber 196 fall in a stream by gravity into a chute 206 formed by the baffle portions 60, 66 and down into the abrasive particle supply passage 104. Then, as is illustrated in FIG. 3, the abrasive particles fall onto the accelerator wheel 180 and in turn are accelerated to the left into the path of a downwardly descending vane 164.

The specific relationship of the flow of the abrasive particles from the accelerator wheel 180 to the throwing wheel 90 will be described in detail hereinafter.

Figure 4:
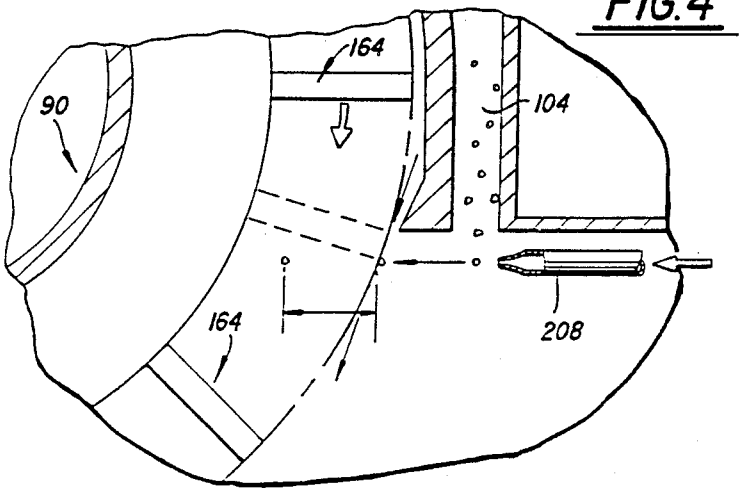
FIG. 4 is a view similar to FIG. 3 but utilizing a pneumatic accelerator.

At this time reference is made to FIG. 4 wherein in lieu of the accelerator wheel 180, other abrasive particle accelerator means may be employed. As an example, a fluid nozzle 208 may be utilized to direct the descending abrasive particles towards the throwing wheel 90 and to accelerate the particles in their movement towards the throwing wheel 90 for engagement by a throwing vane thereof.

As will be apparent from FIG. 1, the lower part of the baffle portion 98 is provided with an opening 210 which is an outlet opening for abrasive particles being thrown by the throwing wheel 90. The outlet opening 210 is generally aligned with the wider discharge opening 114 which extends between the more widely spaced walls 18 and 20 as compared with the walls 14, 16. This, in turn, permits the return passage to be described hereinafter to be wider than the outlet opening 210 for maximum return flow of air, abrasive particles and removed material. More specifically, the return passage is of a greater width than the chamber 88 which carries the throwing wheel 90.

In order to control the direction of flow of the abrasive particles from the throwing wheel 90, and also to protect the sealing member 118, there is a wear plate 212. The wear plate 212 is removably mounted on the baffle portion 70 and extends through the outlet opening 210 to a position at the discharge opening 114. The wear plate 212 also forms the rear boundary of the discharge opening 114.

It is to be noted that the upper part of the wear plate 212 is in the form of a curved portion 214 which together with the baffle portion 68 defines a chamber for the accelerator wheel 180. The upper end of the curved portion 214 terminates in spaced relation below the enlargement 106 on the baffle portion 104 and together therewith define an inlet opening into the chamber 88.

It will be seen that abrasive particles thrown by the throwing wheel 90 are directed against the surface 32 being cleaned and bounced upwardly therefrom into a passageway 216 defined between the lower part of the front wall 22 and the baffle 92. The return passage for the abrasive particles and material removed from the surface 32 continues as at 218 above the baffle 34 between the baffle portions 32, 40 and down into the abrasive particle supply chamber 196.

Air is drawn through the returning abrasive particles and removed material carried therewith through a torturous passage indicated by the arrows A into a vacuum line 220. The vacuum line 220, together with the vacuum line 82 are connected to a vacuum cleaner unit (not shown). Thus both the returning abrasive particles and those abrasive particles being directed to the accelerator wheel 180 are subject to a cleaning.

It is understood that not all rebounding abrasive particles will have sufficient energy to continue into the returning passageway 218 over the top of the baffle 34. Those abrasive particles which do not go this far, will drop onto the baffle 34 and will flow down the baffle 34 through an opening 222 between the baffles 34 and 92 back towards the throwing wheel 90. The abrasive particles will then land on the baffle portion 100 and will be directed back into the supply passage 104 directly to the accelerator wheel 180.

The opening 222 also defines a discharge portion through which abrasive particles may be discharged by the throwing wheel 90. Certain of the abrasive particles will bounce back up into the throwing wheel 90 and will be carried by the throwing wheel 90 behind the baffle 92 and discharged out through the opening between the baffle portions 94, 108 into the opening 222 for return to the system.

With continuing reference to FIG. 1, it will be seen that it is also feasible to provide above the discharge opening 114 a further wear plate in the form of a baffle 224 which protects the lower portion 112 of the front wall and the sealing member 116 from direct flow of abrasive particles from the throwing wheel.

It is also to be understood that there are other baffles, screens, etc. which may be illustrated, but are not specifically described because in of themselves, they form no part of this invention.

A comparison of the surface cleaner of this invention will now be made with respect to the leading prior art cleaners.

Considering units such as described in U.S. Pat. No. 4,416,092, it will be seen that the abrasive is discharged from the hopper in close proximity to the wheel blades. Since the abrasive has only a short distance to travel, the horizontal velocity feeding into the path of the blades is only 22"/sec. with a wheel speed of 3500 RPM with four blades. Further, the abrasive only penetrates 3/32" into the path of the blade. This is a serious deficiency due to the fact that many particles are being hit on a small area such that particles are not batted individually, but as gobs of abrasive several layers thick. In this case, the abrasive particles are not batted to full velocity due to particles batted being on top of each other. Additionally, velocity and direction control is lost due to the billiard ball effect of particle on particle. If the flow rate of the abrasive particles utilizing particles of a 0.0230" diameter, is 1000#/hr./in. a blade width, each blade hits 430 particles, whereas only 183 particles can fit into an area of 3/32"×1". Further, if 8 blades are used, the area would be 3/64"×1".

Another problem with the foregoing unit is that the wear on the blade is concentrated on the 3/32" area at the tip of the blade. This creates two problems. One is that blade wear is rapid due to all of the impact energy being concentrated in a small area. The other problem is that the concentrated wear soon rounds the blade tip so that the abrasive particles hit by this rounded tip tend to billiard ball off at angles other than 90 to the blade resulting at lower abrasive velocity, higher blade wear, and difficulty in controlling the rebound angles back to the storage bin.

On the other hand, with units of the type disclosed in U.S. Pat. No. 4,377,924 there are different deficiencies. The angle of impact of all abrasive particles is approximately 60 so that the actual impact angles are compound angles of for example 60 in the side elevation and 40 in the front elevation which gives an actual 37 impact angle. At 90 in the front elevation, the actual impact angle would be 60.

With the blast system of U.S. Pat. No. 4,377,924 it is impossible to obtain equal blast energy across the width of the cleaning path. Since the impact energy at the sides of the path is considerably less than that at 90 or at the center of the cleaning path, the cleaning rate is governed by the weakest impact energy and the area at 90 , etc. is overblasted. On typical plate blasting machines of this type, the problem is overcome by combining the tail stream of another throwing wheel to reinforce the area.

Another problem with this type of unit is that the particles which hit at 40 and other relatively shallow angles rebound more to the side than to the front, resulting in difficulty in getting the abrasive to rebound efficiently up to the return corridor to the abrasive particle supply chamber. In accordance with prior units, considerable air draft must be induced to help the particles find their way up to the rebound corridor.

Yet another difficulty with the cleaner of U.S. Pat. No. 4,377,924 is that the tail stream, and to a lesser extent, the head stream, is directed at the sealing system, thus complicating the retention of abrasive particles and increasing wear on the seals.

As discussed above, and as is specifically illustrated in FIG. 3, the abrasive particles batted by the accelerator wheel have a velocity of approximately 565 in./sec. so that with the throwing wheel rotating at 3500 RPM, and with 8 blades, the abrasive can penetrate into the path of each vane up to 1.21 in. In this case, with a flow of 1000#/hr./in. width, each blade hits 215 particles of 0.0230 in. diameter particles over an area of 1.21"×1" or 1.21 in. 2236 particles would fit single layer in this area. Thus, it can be seen that in accordance with this invention, the batting action would be very efficient with most particles being individually batted. Additionally, since 8 vanes are used and the effective area of the vanes has increased the wear area of the vanes in accordance with this invention is at a ratio of 28.5 to 1 with respect to the prior art cleaner.

Further, in accordance with this invention, the ricochet angle is much better with the result that the average particle will rebound up the return path back into the abrasive particle supply chamber. Thus the only required air velocity is that for removing the dust generated by the cleaning effect.

Figure 5:
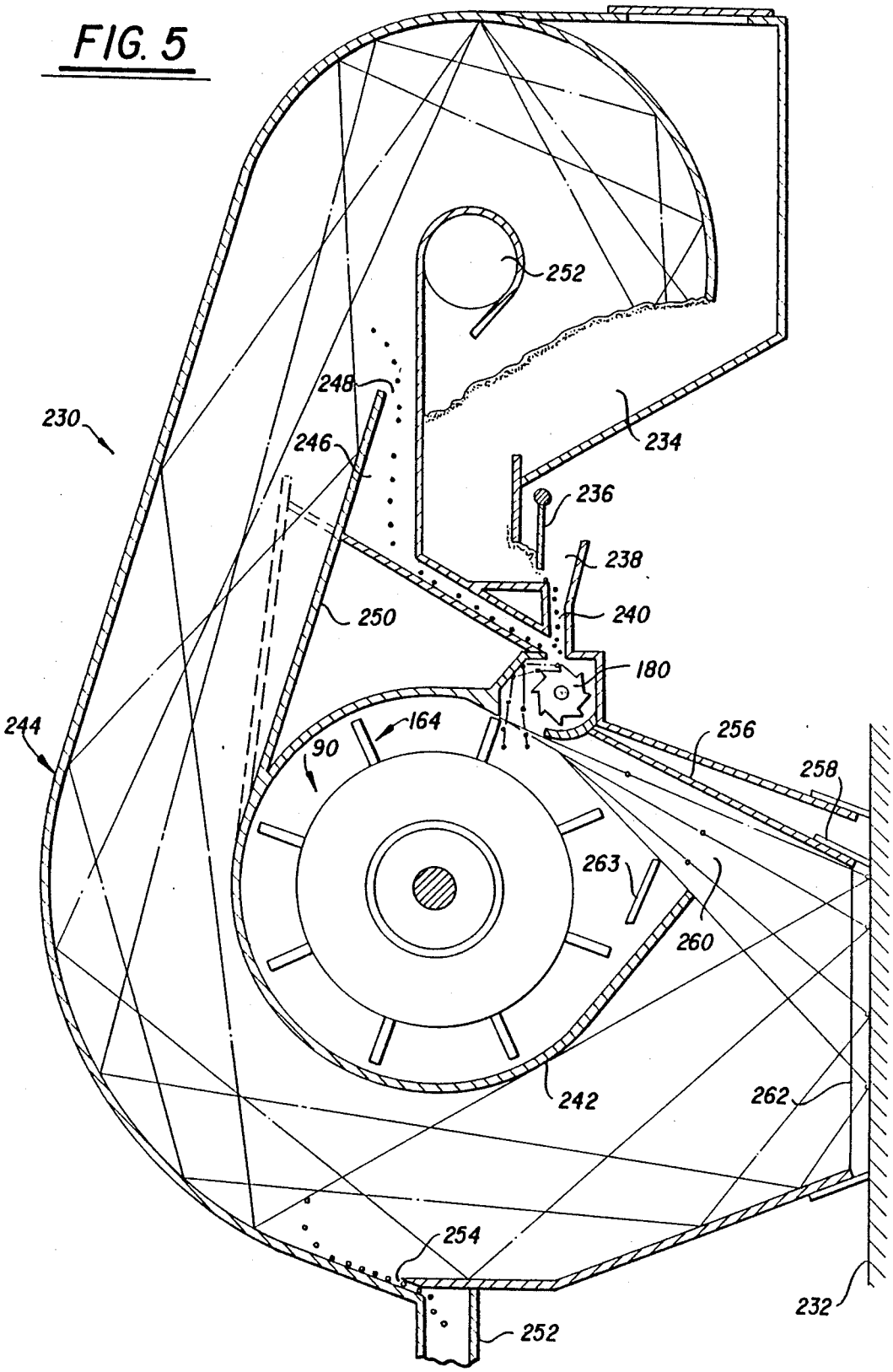
FIG. 5 is a vertical sectional view similar to FIG. 1 of a modified form of the surface cleaner for cleaning a vertical surface.

Reference is now made to FIG. 5 wherein there is illustrated a modified form of surface cleaner generally identified by the numeral 230. The surface cleaner 230 is particularly constructed to clean a vertical surface 232. In view of the specific description of the various features of the housing, baffles, etc. of the cleaner 10, it is not believed that a description of all of the baffles, etc. is required for an understanding of this modified form of cleaner. It will be seen, however, that the throwing wheel 90 is so positioned relative to the accelerator wheel 180 that abrasive particles engaged by the vanes 164 will be directed to the right and slightly downwardly. The abrasive particles will be stored in a supply chamber 234 with the flow from the supply chamber 234 being controlled by a gate 236. The abrasive particles will flow in a stream into a hopper area 238 and down through a supply passage 240 to the accelerator wheel 180. The accelerator wheel 180 will then direct the abrasive particles into the path of the vanes 164.

The throwing wheel 90 is mounted within a housing 242 and rebounding abrasive particles will flow through a lower portion of the cleaner housing 244 below the throwing wheel housing 242 and then up to the left to the top of the housing 244 for return to the abrasive particle supply chamber 234.

There is also an abrasive particle return passageway 246 having an entrance 248 which is below the top of the rebound passageway leading into the supply chamber 234. The passageway 236 leads directly to the accelerator wheel 180. If desired, the entrance may be made lower and wider by shortening and changing the angle of a baffle 250 which defines the entrance 248.

The returning abrasive particles are cleaned by means of air being drawn therethrough through a vacuum line 252 which is in an out of the way position.

Those abrasive particles and foreign matter which do not rebound to the upper portion of the housing 244 may be dispensed through a discharge tube 252 carried by a lower part of the housing 244 with there being an entrance opening 254 into the discharge tube.

The cleaner 230 also incorporates a wear plate 256 which defines the top side of the abrasive particle flow path and protects a portion of the housing 244 as well as the housing seals. If desired, the wear plate 256 may be provided with a seal 258 which supplements the housing seals.

It will be seen that particle flow from the throwing wheel 90 is through an outlet 260 in the housing 42 towards a discharge passage 262 defined by the housing 244 adjacent the surface 232 to be cleaned.

If desired, there may be a further wear plate 263 in the form of a baffle which also serves to define the flow path of the abrasive particles from the throwing wheel, the baffle 263 deflecting particles engaging it back to the throwing wheel 90.

It is to be understood that the surface cleaner 230 may be mounted on suitable wheels or may otherwise be supported with respect to the surface 232.

Figure 6:
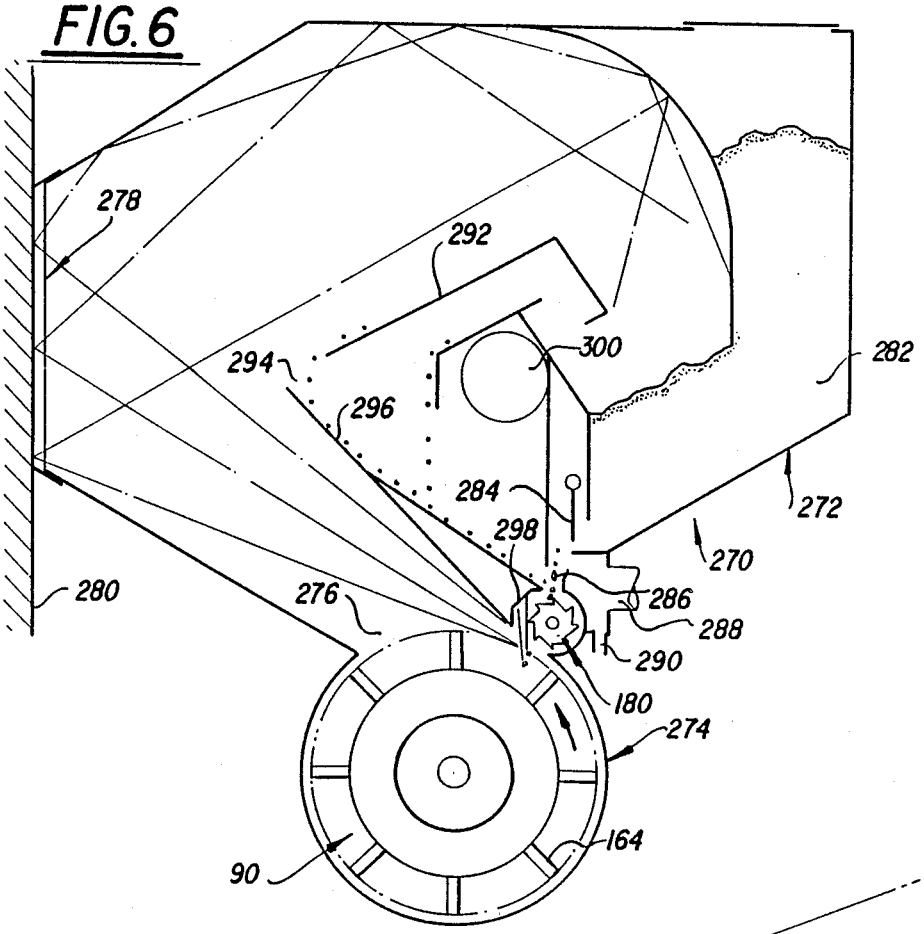
FIG. 6 is a schematic vertical sectional view taken through another form of surface cleaner for cleaning a vertical surface.

Referring now to FIG. 6, it will be seen that there is illustrated another form of surface cleaner of which only the basic elements will be specifically described.

The cleaner 270 includes a housing 272 of which a lower portion defines a generally cylindrical housing 274 for the throwing wheel 90. The housing 274 has an outlet 276 which is aligned with a discharge opening 278 through which abrasive particles may be directed to a vertical surface 280 to be cleaned.

In this instance, the throwing wheel 90 rotates in a counterclockwise direction as does the accelerator wheel 180. The accelerator wheel 180 is positioned above the throwing wheel 90 and receives abrasive particles from an abrasive particle supply chamber 282 through an exit passage controlled by a gate member 284 down a supply passage 286. Air is drawn through the abrasive particles flowing to the accelerator wheel 180 through a vacuum line 288 with any fallout of sand or like material from the air flowing into the vacuum line 288 passing into a discharge tube 290.

Rebounding abrasive particles will rebound into the upper part of the housing 272 and back into the supply chamber 282. Those abrasive particles which do not have sufficient energy to rebound into the supply chamber 282, will fall on a baffle member 292 and pass into an opening 294 onto a baffle 296 which directs those returning abrasive particles to the accelerator wheel 180. At this time it is pointed out that the lower part of the baffle 296 defines a rebounding surface 298 against which the abrasive particles from the accelerator wheel 180 are thrown and rebound into the path of the vanes 164.

The returning abrasive particles are also cleaned by way of a vacuum line 300 which opens into a concealed area to which the air must flow through a torturous passage but through the returning abrasive particles.

Figure 7:
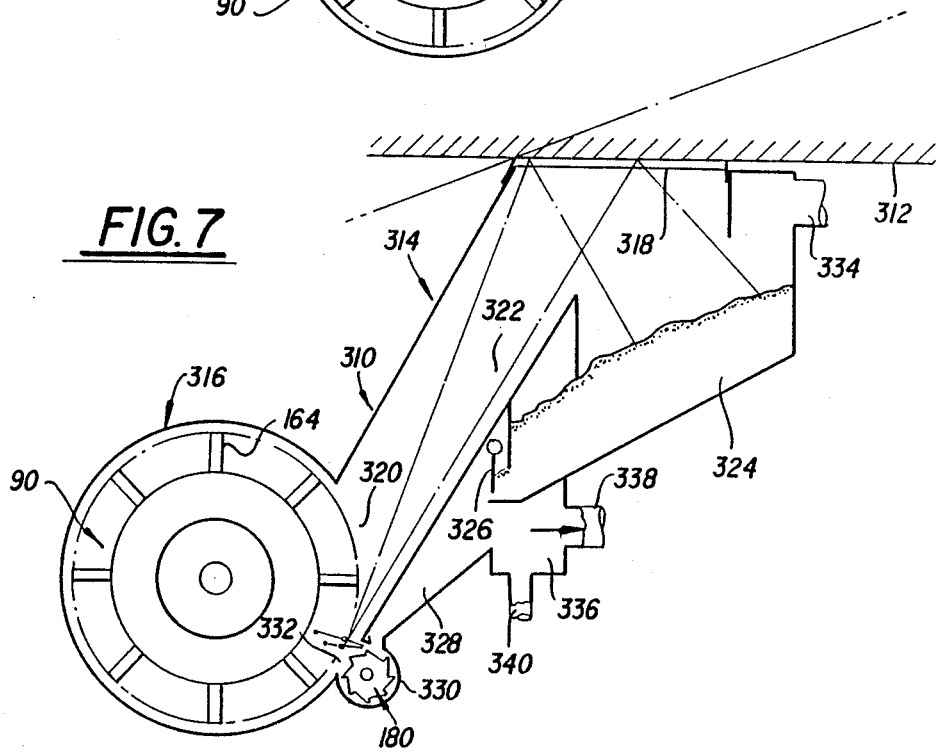
FIG. 7 is a further schematic vertical sectional view showing a further modification of the surface cleaner for cleaning the underside of a horizontal surface.

Reference is now made to FIG. 7 wherein there is illustrated a further form of surface cleaner, generally identified by the numeral 310 and being specifically constructed to clean the underside of a horizontal surface 312. The cleaner 310 includes a housing 314 of which a portion defines a housing 316 for the throwing wheel 90.

The top of the housing 314 has a discharge opening 318 opening towards the surface 312. The housing 316 has an outlet 320 aligned with the discharge opening 318 and in communication with the discharge opening 318 through an elongated abrasive particle flow passage 322. The upper right portion of the housing 314 defines an abrasive particle supply chamber 324 and flow of abrasive particles from the supply chamber 324 is effected by a gate member 326. The abrasive particles from the chamber 324 flow into a supply passage 328 to the accelerator wheel 180 which is mounted within a housing 330. Abrasive particles are impelled into the path of the vanes 164 through an inlet 332 in the housing 316.

The upper right hand part of the housing 314 is supplied with a vacuum line 334 to withdraw dust and other foreign matter from the returning abrasive particles. Further, the stream of abrasive particles flowing from the supply chamber 324 has air drawn therethrough into a chamber 336 which is provided with a vacuum line 338. The bottom of the chamber 336 is provided with a discharge tube 340.

Although the cleaners 270 and 310 have only been schematically illustrated, it will be seen that the principles of operation thereof are fully illustrated and have been fully described. It is to be understood that the units are self-contained with there being the necessary vacuum cleaner systems and supports as well as the drive unit for the throwing wheel 90 and the accelerator wheel 180.

Although only several preferred embodiments of the surface cleaner have been specifically illustrated and described herein, it is to be understood that minor variations may be made in the surface cleaner without departing from the spirit and scope of the invention as defined by the appended claims.

I claim:

1. A surface cleaner comprising a housing including side walls joined together by transverse walls and having a discharge opening, partition walls extending between said side walls to define a chamber for a throwing wheel, a return passage, and abrasive cleaning and supply areas, said chamber having an outlet generally aligned with and facing said discharge opening, said outlet being narrower in a transverse direction than said discharge opening, said side walls including transversely offset portions wherein the width of said housing at said chamber and said abrasive cleaning and supply areas is narrow in a transverse direction as compared to the width of said housing at said discharge opening and said return passage whereby a maximum return of discharged abrasive particles and removed matter carried thereby is effected.

2. A surface cleaner according to claim 1 wherein said side wall offset portions occur generally at certain of said partitions.

3. A surface cleaner according to claim 1 wherein said return passage is a direct return continuation of said discharge opening.

4. A surface claim according to claim 1 wherein said throwing wheel chamber outlet opens towards said discharge opening remote from an entrance into said return passage generally in reflective relation thereto.

5. A surface cleaner according to claim 1 wherein said throwing wheel chamber outlet is in part defined by a lower sloping transverse wall portion sloping towards said discharge opening in reflective relation towards said return passage.

6. A surface cleaner according to claim 5 wherein said sloping transverse wall is in the form of a wear plate.

7. A surface cleaner according to claim 1 wherein said outlet is in one of said partition walls.

8. A surface cleaner according to claim 1 wherein said outlet is in one of said partition walls which also defines a wall of said return passage.

9. A surface cleaner according to claim 1 wherein said outlet is in one of said partition walls which is located generally at offsets in said side walls.

10. A surface cleaner according to claim 1 wherein portions of said partition walls defining said chamber include oppositely opening curved portions.

11. A surface cleaner according to claim 10 wherein said throwing wheel chamber outlet is in part defined by a lower sloping transverse wall portion sloping towards said discharge opening in reflective relation towards said return passage.

12. A surface cleaner according to claim 10 wherein said chamber is internally shaped to receive a throwing wheel having a transverse axis.

13. A surface cleaner according to claim 10 wherein said chamber is internally shaped to receive in close fitting relation a single throwing wheel.

14. A surface cleaner according to claim 10 wherein said chamber is internally shaped to receive in close fitting relation a single throwing wheel having a transverse axis.

15. A surface cleaner comprising a housing including side walls joined together by transverse walls and having a discharge opening, partition walls extending between said side walls to define a chamber for a throwing wheel, said partition walls defining said chamber including oppositely opening curved portions, a return passage, and abrasive cleaning and supply areas, said chamber having an outlet generally aligned with and facing said discharge opening, said outlet being narrower in a transverse direction than said discharge opening, said side walls including transversely offset portions wherein the width of said housing at said chamber is narrow in a transverse direction as compared to the width of said housing at said discharge opening and said return passage whereby a maximum return of discharged abrasive particles and removed matter carried thereby is effected.

16. A surface cleaner according to claim 15 wherein said throwing wheel chamber outlet is in part defined by a lower sloping transverse wall portion sloping towards said discharge opening in reflective relation towards said return passage.

17. A surface cleaner according to claim 15 wherein said chamber is internally shaped to receive in close fitting relation a single throwing wheel.

18. A surface cleaner comprising a housing including side walls joined together by transverse walls and having a discharge opening, partition walls extending between said side walls to define a chamber for a throwing wheel, a return passage, and abrasive cleaning and supply areas, said chamber being internally shaped to receive a throwing wheel having a transverse axis and having an outlet generally aligned with and facing said discharge opening, said outlet being narrower in a transverse direction than said discharge opening, said side walls including transversely offset portions wherein the width of said housing at said chamber is narrow in a transverse direction as compared to the width of said housing at said discharge opening and said return passage whereby a maximum return of discharged abrasive particles and removed matter carried thereby is effected.

19. A surface cleaner according to claim 18 wherein portions of said partition walls defining said chamber includes oppositely opening curved portions.

* * * * *